US006347148B1

(12) United States Patent
Brennan et al.

(10) Patent No.: US 6,347,148 B1
(45) Date of Patent: Feb. 12, 2002

(54) METHOD AND APPARATUS FOR FEEDBACK REDUCTION IN ACOUSTIC SYSTEMS, PARTICULARLY IN HEARING AIDS

(75) Inventors: Robert Brennan, Kitchener; Anthony Todd Schneider, Waterloo, both of (CA)

(73) Assignee: Dspfactory Ltd., Waterloo (CA)

( * ) Notice: Subject to any disclaimer, the term of this patent is extended or adjusted under 35 U.S.C. 154(b) by 0 days.

(21) Appl. No.: 09/060,822

(22) Filed: Apr. 16, 1998

(51) Int. Cl.[7] ..... H04R 25/00

(52) U.S. Cl. ..... 381/318; 381/312; 381/93; 381/320

(58) Field of Search ..... 381/231.1, 312, 381/318, 320, 321, 83, 93, 94.2, 71.11, 71.12, 71.13, FOR 127, FOR 129, FOR 131

(56) References Cited

U.S. PATENT DOCUMENTS

| | | | | |
|---|---|---|---|---|
| 5,016,280 | A | 5/1991 | Engebretson | 381/68 |
| 5,091,952 | A | 2/1992 | Williamson et al. | 381/68.2 |
| 5,201,006 | A | 4/1993 | Weinrich | 381/68 |
| 5,259,033 | A | 11/1993 | Goodings et al. | 381/68 |
| 5,276,739 | A | 1/1994 | Lrokstad et al. | 381/68.2 |
| 5,475,759 | A | 12/1995 | Engebretson | 381/68.2 |
| 5,619,580 | A | 4/1997 | Hansen | 381/68.2 |
| 5,649,019 | A | 7/1997 | Thomasson | 381/83 |
| 5,661,814 | A | 8/1997 | Kälin et al. | 381/68.2 |

FOREIGN PATENT DOCUMENTS

| | | |
|---|---|---|
| WO | WO 97/16942 | 3/1997 |

*Primary Examiner*—Huyen Le
(74) *Attorney, Agent, or Firm*—Bereskin & Parr

(57) ABSTRACT

There is provided a method of controlling feedback in an acoustic system, for example a digital hearing aid, in which there is a potential feedback path between the output and the input. The method comprises making a spectral estimate of the input signal spectrum, and then subjecting the spectral estimate to a psycho-acoustic model to generate a control signal. A noise source is passed through a shaping filter, which is controlled with the control signal, to generate frequency-shaped noise, which is inaudible to someone hearing the output. The frequency-shaped noise is then added to the input signal to form a combined signal, which is processed in a forward path, to generate a first output signal. The first output signal and the frequency-shaped noise signal are analyzed, to determine the presence of feedback at difference frequencies, and the characteristics of the forward path are modified to reduce the gain thereof at frequencies where feedback is detected.

11 Claims, 3 Drawing Sheets

METHOD AND APPARATUS FOR FEEDBACK REDUCTION IN ACOUSTIC SYSTEMS, PARTICULARLY IN HEARING AIDS

FIELD OF THE INVENTION

This invention relates to a method and apparatus for reducing feedback in acoustic systems, particularly hearing aids. More specifically, the invention relates to hearing aids that employ digital processing methods to implement hearing loss compensation and other forms of corrective processing, and is concerned with reduction of acoustic feedback in such hearing aids.

BACKGROUND OF THE INVENTION

Acoustic feedback in hearing aids occurs because the gain and phase of the acoustic path from the receiver to the microphone are such that a feedback signal arrives at the microphone in phase with the input signal and with a magnitude that is greater than or equal to the input signal. This problem is especially prevalent in high-power hearing aids. A number of methods have been developed in the past for acoustic feedback reduction in digital hearing aids. Recently, techniques that use digital signal processing have been proposed.

Kates, J. (*Feedback Cancellation in Hearing Aids: Results from a Computer Simulation, IEEE Trans. on Acoustics Speech and Signal Processing,* 1991, 39:553–562) implemented a scheme where the open-loop transfer function of the hearing aid is estimated by opening the forward signal path of the hearing aid and injecting a short-duration (50 ms) noise probe signal. Because the probe signal is very short in duration, it is inaudible to the hearing aid user. (It may, however, reduce the intelligibility of the processed speech signal.) When acoustic feedback is detected, the forward path is opened, the noise signal is injected and an adaptive filter is adjusted to estimate the transfer function of the feedback path and eliminate the acoustic feedback. Computer simulations demonstrated that this scheme provides the potential for 17 dB of feedback cancellation. A more recent scheme proposed by Maxwell, J. and Zurek, P. (*Reducing Acoustic Feedback in Hearing Aids, IEEE Trans. on Speech and Audio Processing*, Vol. 3, No. 4, pp. 304–313, July 1995) is similar in operation except that it adapts during the "quiet" intervals of the input speech signal, as well as adapting when feedback is detected.

Dyrlund, O. and Bisgaard, N. (*Acoustic Feedback Part 2: A Digital Feedback System for Suppression of Feedback, Hearing Instruments*, Vol. 42, No. 10, pp. 44–25, 1991); and Dyrlund and Bisgaard (*Acoustic Feedback Margin Improvements in Hearing Instruments Using a Prototype DFS (digital feedback suppression) System, Scand Audiology*, Vol. 20, No. 1, pp. 49–53, 1991) developed a scheme that was implemented in a commercial hearing aid, the Danavox DFS. This scheme continuously characterizes the acoustic feedback path with an injected noise signal. If feedback is detected, the DFS algorithm injects a cancellation signal into the hearing instrument signal path that is at the same frequency but has opposite phase to the feedback signal. This scheme can provide 8–15 dB higher gain than a hearing aid without feedback reduction. However, it has the disadvantages that the injected noise signal may be audible for some listeners and that the noise signal may mask some speech cues at higher frequencies.

BRIEF SUMMARY OF THE PRESENT INVENTION

The present invention provides a feedback scheme which uses a filtered noise source that is passed through a shaping filter whose frequency response is dependent on the spectrum of the input signal and a simplified model of the human auditory system. If the filter is adapted in a known manner [Jayant, N., Johnson J., and Safranek, R., *Signal Compression Based on Models of Human Perception, Proc. of IEEE*, Vol. 81, No. 10, pp. 1385–1422, October 1993] the shaped noise signal that is added to the hearing aid input signal (at a relatively low signal-to-noise ratio of 15 dB or greater) will be inaudible to the hearing aid wearer. This inaudibly shaped noise source is used continuously to characterize the acoustic feedback path. If feedback is detected, adjustments are made in the hearing aid frequency response to eliminate it.

In accordance with the present invention, there is provided a method of controlling feedback in an acoustic system having an input for an acoustic input signal and output signal that generates a potential feedback path between the output and the input, the method comprising the steps of:

(1) generating a first input signal from the acoustic input signal and making a spectral estimate of the first input signal;

(2) subjecting the spectral estimate to a psycho-acoustic model to generate a control signal;

(3) passing a noise signal through a shaping filter and controlling the shaping filter with the control signal, to generate frequency-shaped noise, which is inaudible to someone hearing the acoustic output signal;

(4) adding the frequency-shaped noise to the first input signal to form a combined signal;

(5) processing the combined signal in a forward signal path having a transfer function, to generate a first output signal;

(6) analyzing the first output signal and the frequency-shaped noise signal, to determine the presence of feedback at different frequencies;

(7) using the first output signal to generate the acoustic output signal; and (8) modifying the transfer function of the forward signal path, to reduce the gain thereof at frequencies where feedback is detected.

Preferably, in step (2), the psycho-acoustic model selected from one of a normative psycho-acoustic model and a measured psycho-acoustic model representative of the hearing characteristics of an individual.

In a further embodiment of the present invention, step (6) comprises forming a cross-spectral estimate between the first output signal and the frequency-shaped noise and an auto-spectral estimate for the frequency-shaped noise, dividing the cross-spectral estimate by the auto-spectral estimate to obtain a spectral ratio, and determining when the frequency response of the spectral ratio varies from the frequency response of the forward path, indicative of feedback.

The method of the present invention can be applied to any suitable acoustic system, for example a digital hearing aid or a public address system.

In another embodiment of the present invention, steps (3) and (6) are based on maximum length sequence methods, such that step (3) comprises taking the fast Hadamard transform of the control signal to generate the frequency-shaped noise, and step (6) comprises taking the fast Hadamard transform of the first output signal from the forward path, generating the power spectrum of the fast Hadamard transform of the first output signal and the power spectrum of the fast Hadamard transform of the control signal, and dividing the two power spectrums to obtain a spectral ratio from which feedback can be detected.

The present invention also provides apparatus corresponding to the method aspects just defined. The apparatus is for processing an acoustic signal and generating an acoustic output, and the apparatus comprises:

an input means for receiving an acoustic input signal and for generating a first input signal;

an output transducer for generating an output acoustic signal;

a forward signal path within the apparatus connecting the input means to the receiver and having a main transfer function for generating a first output signal;

a feedback path between the receiver and the input means enabling at least a portion of the output acoustic signal to be received at the input means;

a spectral estimation means connected to the input means for receiving the first input signal and for generating a spectral estimate of the acoustic input signal;

a psycho-acoustic model means connected to the spectral estimation means for forming a control signal from the spectral estimate;

a noise generation means connected to the psycho-acoustic model means for generating a noise signal whose spectrum is dependent upon the control signal;

means for adding the noise signal to the first input electrical signal to form a combined signal, for processing in the forward signal path; and means for analyzing the noise signal and the combined signal after processing in the forward signal path to determine the presence of feedback and for modifying the main transfer function of the forward path to eliminate any substantial acoustic feedback.

BRIEF DESCRIPTION OF THE DRAWING FIGURES

For a better understanding of the present invention, and to show more clearly how it may be carried into effect, reference will now be made, by way of example, to the accompanying drawings in which.

DESCRIPTION OF THE PREFERRED EMBODIMENT

Figure 1:
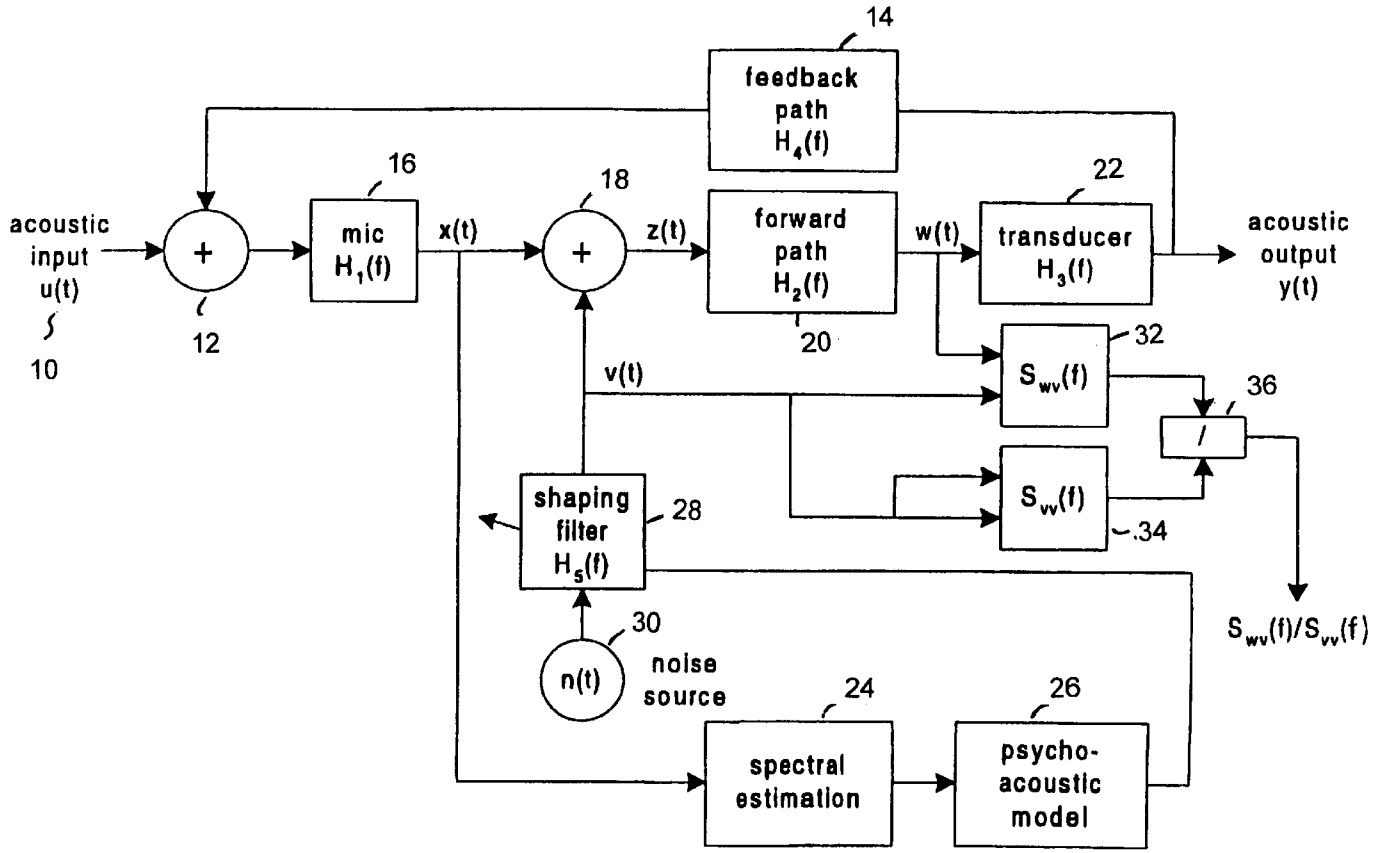
FIG. 1 is a schematic, block diagram of a first embodiment of the present invention.

Referring first to FIG. 1, a first embodiment of the hearing aid has an input 10 for an acoustic signal u(t). This input 10 and a feedback path 14 are connected to a summation unit 12 which represents the acoustic summation of the input and feedback signals. The output of the summation unit 12 is connected to block 16 representing a microphone transfer function $H_1(f)$. At the output of the microphone block 16, there is the basic input signal x(t).

In accordance with the present invention, the signal x(t) passes to a further summation unit 18, where it is added to a shaped noise signal v(t). At the output of the summation unit 18, the summed signal z(t) is subject to the forward path transfer function $H_2(f)$, as indicated at block 20.

The output of the forward path, a signal w(t) is fed to a transducer 22, which applies the transfer function $H_3(f)$, to yield an acoustic output y(t). The acoustic output signal, y(t), is fed back to the input via an acoustic transfer function which is represented by $H_4(f)$, as indicated in the feedback path 14.

Now, in accordance with the present invention, the input signal x(t) is also supplied to a spectral estimation unit 24, which in turn is connected to a psycho-acoustic model unit 26. The output of the psycho-acoustic model 26 controls a shaping filter $H_5(f)$ 28 which receives an input from a noise source 30 and which is used to shape the frequency spectrum of the noise source 30. In known manner, the noise source 30 generates a random noise signal which can then be used for test purposes. The output of the shaping filter 28 is the frequency shaped noise signal v(t).

As indicated at 32, a cross-spectral estimate, $S_{wv}(f)$, is made between shaped noise signal v(t) and the signal w(t) at the output of the forward path. Similarly, the shaped noise signal v(t) is supplied to unit 34, to determine an auto-spectral estimate $S_{vv}(f)$. These are divided at 36, to give the ratio $S_{wv}(f)/S_{vv}(f)$.

The frequency domain transfer functions $H_1(f)$, $H_2(f)$ and $H_3(f)$ represent the "normal" forward electro-acoustic transfer function of the electro-acoustic system if acoustic feedback is at a negligible level. The acoustic feedback path transfer function is $H_4(f)$.

The noise source n(t) is filtered with a digital shaping filter 28, $H_5(f)$, whose coefficients (and hence frequency response) are periodically updated (for example at 20 to 30 ms intervals) based on an estimate of the short-term input signal spectrum and a psycho-acoustic model. The shaping filter is adjusted so that the noise-to-signal ratio (where the "noise" is the shaped noise $N(f)H_5(f)$) of the input signal in the "forward path" z(t) is maximized while ensuring that the injected frequency-shaped noise is inaudible to the hearing aid wearer when masked by the input signal. For a hearing aid application, the psycho-acoustic model may be generic (i.e., based on normative data for the general class of hearing characteristic) or specific (i.e., based on specific characteristics of the user's hearing characteristic).

The frequency domain transfer function from the input U to the output Y is: $Y(1-H_1H_2H_3H_4)=H_2H_3H_5N+H_1H_2H_3U$. If the noise source is set to zero, we arrive at the well-known transfer function:

$$\frac{Y}{U}=\frac{H_1H_2H_3}{1-H_1H_2H_3H_4}$$

whose form is characteristic of a feedback system.

The cross- and auto-spectral estimates $S_{wv}(f)$ and $S_{vv}(f)$ are computed in the frequency domain using well known fast Fourier transform (FFT) correlation methods:

$$S_{wv}=H_2(H_5N+H_1(U+H_4Y))(H_5N)^*$$
$$=H_2(|H_5|^2S_{NN}+H_1(H_5^*S_{NU}+H_4H_5^*S_{YN}))$$

where $S_{NN}(f)$=is the auto-spectral density of the noise source, $S_{NU}(f)$=is the cross-spectral density between the noise source and the input signal, $S_{YN}(f)$=is the cross-spectral density between the output signal and the noise source, and

* indicates complex conjugation; and $$S_{vv}=|H_5|^2S_{NN}$$

Because the shaped noise signal (v(t)) is uncorrelated with the input signal over multiple periods of the shaping filter update time (e.g., correlations are computed over 100 to 200 ms periods), $S_{NU}(f)$ asymptomatically approaches zero, and $S_{wv}(f)$ can be approximated as:

$$S_{wv} \cong H_2(|H_5|^2 S_{NN} + H_1 H_4 H_5^* S_{YN})$$

Thus, the ratio of these two spectra can be approximated as:

$$\frac{S_{WV}}{S_{VV}} \simeq \frac{H_2(|H_5|^2 S_{NN} + H_1 H_4 H_5^* S_{YN})}{|H_5|^2 S_{NN}}$$

If the gain of acoustic feedback path ($H_4(f)$) is small (i.e. there is very little or no acoustic feedback), then the ratio of these spectra will be approximately equal to $H_2(f)$ which is known. Thus, the occurrence of feedback can be detected by finding the frequencies where the ratio of the spectra deviates significantly from the known frequency response, $H_2(f)$.

Because the value of $S_{wv}(f)$ may be very small for some input signal conditions, the adaptation at a given frequency will be disabled if $S_{wv}(f)$ falls below a pre-specified level. This satisfies a condition known as persistent excitation which states that a system must be exited at a particular frequency before it can be characterized at that frequency.

Once feedback is detected, it can be eliminated by reducing the gain of $H_2(f)$ at the frequency where the feedback has been detected. In operation, there is a continuous balance between the initial "target" setting of $H_2(f)$ (i.e., the desired frequency response) and the "adjusted" $H_2(f)$ that is required to keep the acoustic system out of the acoustic feedback condition. The algorithm used to adapt the frequency-gain characteristic that constitutes $H_2(f)$ will slowly adapt towards the target setting and only reduce the gain at a particular frequency if feedback is likely to occur at that frequency. The algorithm used to adjust $H_2(f)$ does not form part of the present invention, and any suitable algorithm can be used.

Figure 2:
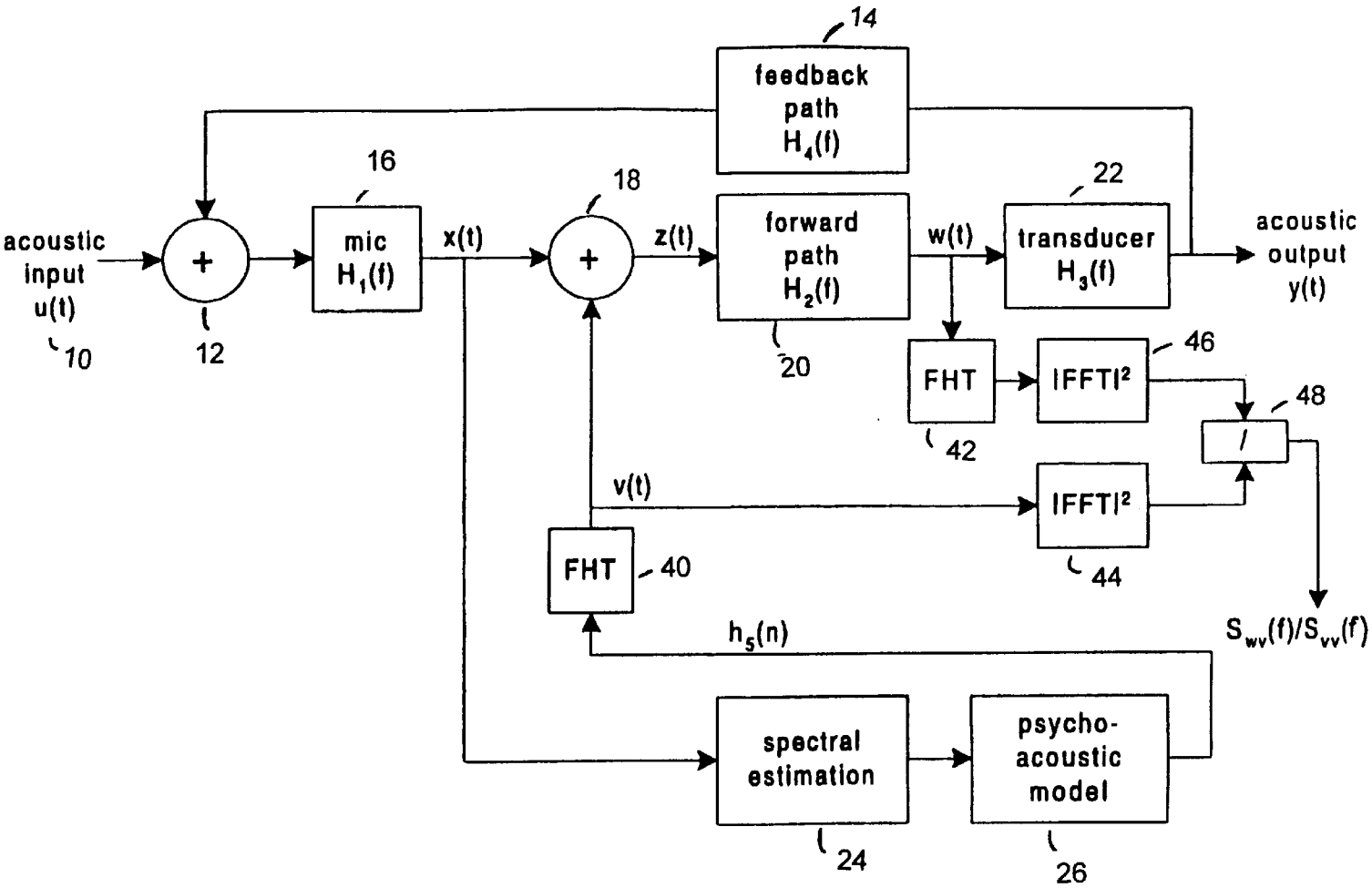
FIG. 2 is a schematic, block diagram of a second embodiment of the present invention.

FIG. 2 shows a second embodiment of the present invention, and similar elements are given the same reference, and for simplicity, description of the common elements is not repeated. This second embodiment of the invention uses maximum length sequence (MLS) methods to characterize the transfer function feedback path.

Here, the psycho-acoustic model 26 supplies filter coefficients to the fast Hadamard transform (FHT) unit 40 which in known manner generates a shaped noise signal: see Borish, J., "An Efficient Algorithm for Generating Colored Noise Using a Pseudorandom Sequence", *J. Audio Engineering Society*, Vol. 33, No. 3, pp. 141–144, (March 1985), which is incorporated herein by reference. The FHT algorithm is described in detail in "An Efficient Algorithm for Measuring the Impulse Response Using Pseudorandom Noise", *J. Audio Engineering Society*, Vol. 31. No. 7, pp. 478–488 (July/August 1983) which is also incorporated herein by this reference. A similar unit 42 takes the fast Hadamard transform (FHT) of the signal W(f) which generates the impulse response of the forward signal path. This operation is equivalent to cross-correlating the shaped input MLS signal with an unfiltered MLS signal. Because the MLS is deterministic and the measurement is synchronous, all components that are asynchronous with the MLS will be spread (more or less) uniformly across the entire impulse response, as disclosed in Rife, D. and Vanderkooy, J., "Transfer-Function Measurement with Maximum-Length Sequences", *J. Audio Engineering Society*, Vol. 37, No. 6, pp. 419–444, (June 1989) and Schneider, T. and Jamieson, D., "Signal-Biased MLS-Based Hearing-Aid Frequency Response Measurement", *J. Audio Engineering Soc.,* Vol. 41, No. 12, pp. 987–997, (December 1993), both being incorporated herein by virtue of these references.

By taking only the initial portion of the impulse response and synchronously averaging a number of these segments in sequence, the components of the signal that are uncorrelated with the MLS (e.g. the acoustic input signal including any feedback) are rejected, and an estimate of $H_2(f)$ can be obtained. The two fast Hadamard transform outputs are then processed by fast Fourier transforms in units 44 and 46 and the magnitude squared is computed (to generate the power spectrum), and then divided at 48 to give the ratio $S_{wv}(f)/S_{vv}(f)$. Accordingly, in this realization the feedback is detected and reduced using the same methods that are described above.

Figure 3:
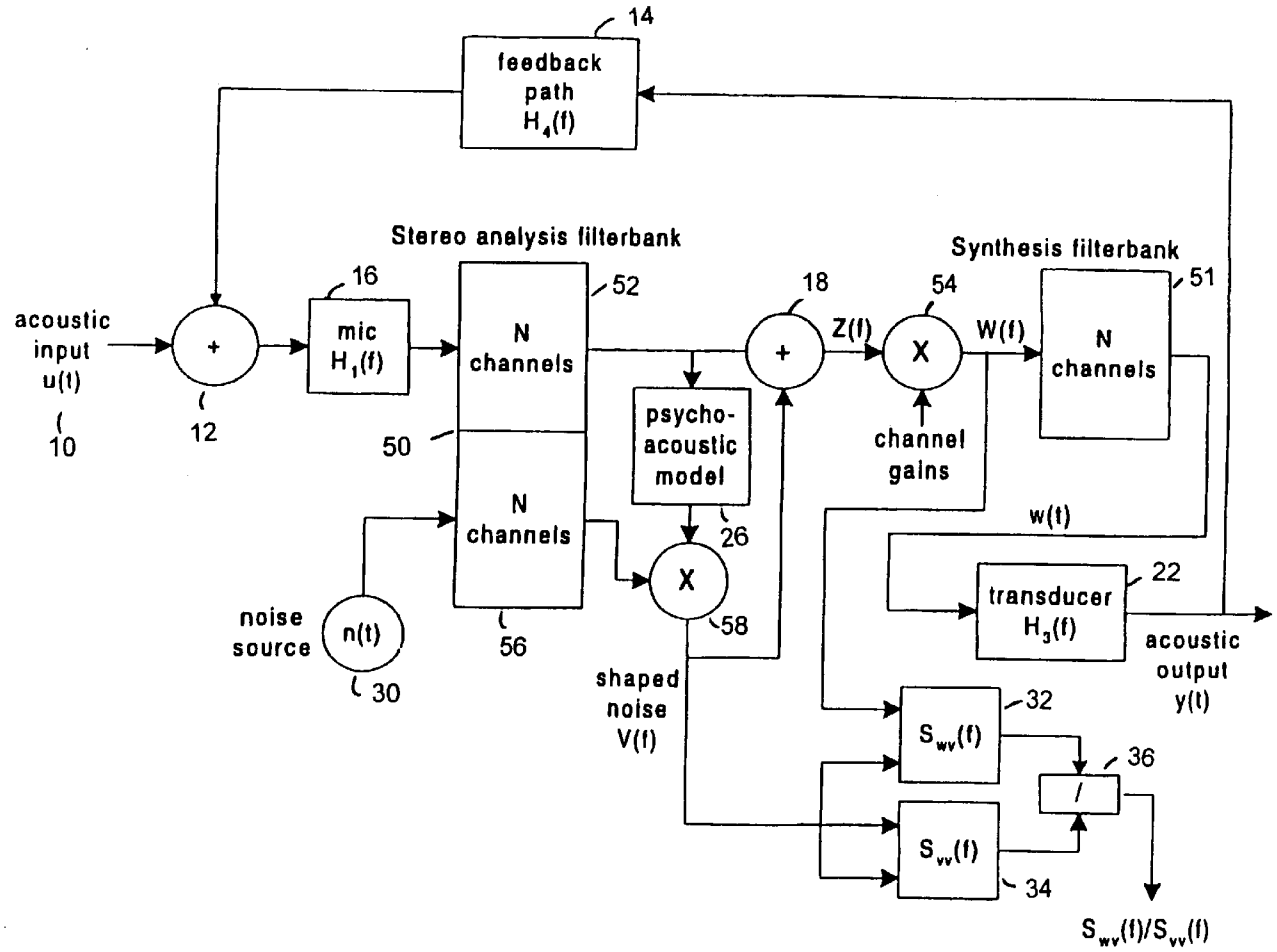
FIG. 3 is a schematic, block diagram of a third embodiment of the present invention.

FIG. 3 shows a third embodiment of the present invention in which similar elements are given the same reference numbers. For simplicity, the description of these common elements is not repeated here. This embodiment of the invention uses a stereo filterbank method (described in copending application Ser. No. 09/060,823) to generate the shaped noise signal. Each section of the stereo analysis filterbank 50 incorporates N channels.

One section 52 of the filterbank 50 is used, in combination with a multiplier unit 54, to generate the forward path transfer function ($H_2(f)$ in FIGS. 1 and 2). The N outputs of this filterbank section are also used to generate an N-channel spectral analysis that is used as the input to a psycho-acoustic model 26. This spectral analysis replaces the spectral estimation carried out at 24 in the earlier Figures. In the embodiment of FIG. 3, the psycho-acoustic model generates N channel gains as an output. The shaped noise signal v(t) (or V(f) in the frequency domain) is generated by applying a white noise source to the input of the other filterbank section 56 (which is equivalent to shaping filter 28 in FIG. 1) and applying N gains (generated by the psycho-acoustic model 26) to a multiplier unit 58. The acoustic output y(t) is generated by first passing the output of the forward path transfer function, W(f), through synthesis filterbank 51 and then providing that signal w(t) to transducer 22.

Accordingly, in this realization the feedback is detected and reduced using the same methods that are described above.

We claim:

1. A method of controlling feedback in an acoustic system having an input for an acoustic input signal and an output for an acoustic output signal that generates a potential feedback path between the output and the input, the method comprising the steps of:

(1) generating a first input signal from the acoustic input signal and making a spectral estimate of the first input signal;

(2) subjecting the spectral estimate to a psycho-acoustic model to generate a control signal;

(3) passing a noise signal through a shaping filter and controlling the shaping filter with the control signal, to generate frequency-shaped noise, which is inaudible to someone hearing the acoustic output signal;

(4) adding the frequency-shaped noise to the first input signal to form a combined signal;

(5) processing the combined signal in a forward signal path having a transfer function, to generate a first output signal;

(6) analyzing the first output signal and the frequency-shaped noise signal, to determine the presence of feedback at different frequencies;

(7) using the first output signal to generate the acoustic output signal; and (8) modifying the transfer function of the forward signal path, to reduce the gain thereof at frequencies where feedback is detected.

2. A method as claimed in claim 1, wherein, in step (2), the psycho-acoustic model is selected from one of a normative psycho-acoustic model and a specific psycho-acoustic model representative of the hearing characteristics of an individual user.

3. A method as claimed in claim 1, wherein step (6) comprises forming a cross-spectral estimate between the first output signal and the frequency-shaped noise and an auto-spectral estimate for the frequency-shaped noise, dividing the cross-spectral estimate by the auto-spectral estimate to obtain a spectral ratio, and determining when the frequency response of the spectral ratio varies from the frequency response of the forward path, indicative of feedback.

4. A method as claimed in claim 1, when applied to one of a digital hearing aid, and a public address system.

5. A method as claimed in claim 1, wherein steps (3) and (6) are based on maximum length sequence methods, such that step (3) comprises taking the fast Hadamard transform of the control signal to generate the frequency-shaped noise, and step (6) comprises taking the fast Hadamard transform of the first output signal from the forward path, generating the power spectrum of the fast Hadamard transform of the first output signal and the power spectrum of the fast Hadamard transform of the control signal, and dividing the two power spectrums to obtain a spectral ratio from which feedback can be detected.

6. A method as claimed in claim 1, wherein in step (1), following generation of the input signal, the input signal is passed through one path of a stereo N channel analysis filterbank, which provides the spectral estimate of the first input signal spectrum so that the psycho-acoustic model generates N channel gains as an output, and wherein step (3) comprises passing the noise signal through the other path of the stereo analysis filterbank to provide output noise channel signals, and multiplying the output noise channel signals by the N channel gains of the psycho-acoustic model to provide the frequency-shaped noise.

7. An apparatus for processing an acoustic signal and generating an acoustic output, the apparatus comprising:

an input means for receiving an acoustic input signal and for generating a first input signal;

an output transducer for generating an output acoustic signal;

a forward signal path within the apparatus connecting the input means to the receiver and having a main transfer function for generating a first output signal;

a feedback path between the receiver and the input means enabling at least a portion of the output acoustic signal to be received at the input means;

a spectral estimation means connected to the input means for receiving the first input signal and for generating a spectral estimate of the acoustic input signal;

a psycho-acoustic model means connected to the spectral estimation means for forming a control signal from the spectral estimate;

a noise generation means connected to the psycho-acoustic model means for generating a noise signal in dependence upon the control signal;

means for adding the noise signal to the first input signal to form a combined signal, for processing in the forward signal path; and means for analyzing the noise signal and the combined signal after processing in the forward signal path to determine the presence of feedback and for modifying the main transfer function of the forward path to eliminate any substantial feedback.

8. An apparatus as claimed in claim 7, wherein the means for analyzing the noise signal comprises:

a first correlation means for forming a cross correlation between the noise signal and the first output signal; and a second correlation means for forming an auto correlation of the noise signal; and means for dividing the cross correlation signal by the auto correlation signal, to generate a ratio of the cross correlation spectrum to the auto correlation spectrum, which is indicative of the forward path transfer function.

9. An apparatus as claimed in claim 7 or 8, wherein the noise generation means comprises a primary noise source for generating a primary noise signal and a shaping filter connected thereto and to the psycho-acoustic model means for generating a noise signal shaped in dependence upon the control signal.

10. An apparatus as claimed in claim 7, wherein the noise generation means comprises means for performing a fast Hadamard transform on the control signal from the psycho-acoustic model means, and wherein the means for analyzing the noise signal comprises:

second fast Hadamard transform means connected to a forward path for generating the fast Hadamard transform of the first output signal;

first power spectrum generating means for generating a first power spectrum of the fast Hadamard transform of the control signal;

second power spectrum generating means for generating a second power spectrum of the fast Hadamard transform of the first output signal;

means for dividing the second power spectrum by the first power spectrum to obtain a signal indicative of the forward path transfer function.

11. An apparatus as claimed in claim 7 or 10, which includes an analysis filterbank connected between the input means and the forward path, the analysis filterbank means providing the spectral estimation means, wherein the noise generation means is connected through the analysis filterbank means and the psycho-acoustic model means is connected to the analysis filterbank means for control thereof, for generating a noise signal in dependence upon said control signal.

* * * * *

UNITED STATES PATENT AND TRADEMARK OFFICE

CERTIFICATE OF CORRECTION

PATENT NO. : 6,347,148 B1
DATED : February 12, 2002
INVENTOR(S) : Brennan et al.

It is certified that error appears in the above-identified patent and that said Letters Patent is hereby corrected as shown below:

Column 1,
Line 46, page references "44 - 25" have been changed to -- 25 - 44 --

Column 5,
Line 18, the word "exited" has been changed to -- excited --

Column 7,
Line 44, the word "signal" has been deleted
Line 47, the word "receiver" has been changed to -- output transducer --

Column 8,
Line 6, the word "signal" has been deleted
Line 8, the second instance of the word "signal" has been deleted Signed and Sealed this Twelfth Day of November, 2002

*Attest:*

*Attesting Officer*

JAMES E. ROGAN
*Director of the United States Patent and Trademark Office*